US007975497B2

(12) United States Patent
Kaga et al.

(10) Patent No.: US 7,975,497 B2
(45) Date of Patent: Jul. 12, 2011

(54) REFRIGERATION UNIT HAVING VARIABLE PERFORMANCE COMPRESSOR OPERATED BASED ON HIGH-PRESSURE SIDE PRESSURE

(75) Inventors: Shinichi Kaga, Toyoake (JP); Akihiko Hirano, Toyoake (JP); Takeshi Ueda, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 419 days.

(21) Appl. No.: 11/819,451

(22) Filed: Jun. 27, 2007

(65) Prior Publication Data

US 2009/0001866 A1 Jan. 1, 2009

(51) Int. Cl.
*F25B 49/00* (2006.01)
*F25B 19/00* (2006.01)

(52) U.S. Cl. ..... 62/228.3; 62/125; 62/126; 62/228.1; 62/228.4; 62/228.5; 62/231

(58) Field of Classification Search ..... 62/125, 62/126, 228.1, 228.3, 228.4, 228.5, 231, 62/226

See application file for complete search history.

(56) References Cited

U.S. PATENT DOCUMENTS

| | | | | |
|---|---|---|---|---|
| 3,298,192 | A * | 1/1967 | Morgan | 62/228.1 |
| 4,196,356 | A * | 4/1980 | Kabat | 307/117 |
| 4,738,116 | A * | 4/1988 | Himeno et al. | 62/186 |
| 5,197,293 | A * | 3/1993 | Okamura et al. | 62/228.4 |
| 5,275,012 | A * | 1/1994 | Dage et al. | 62/208 |
| 5,685,163 | A * | 11/1997 | Fujita et al. | 62/228.3 |
| 2004/0244395 | A1* | 12/2004 | Kim et al. | 62/228.1 |
| 2005/0092012 | A1* | 5/2005 | Hirano et al. | 62/298 |

FOREIGN PATENT DOCUMENTS

| | | |
|---|---|---|
| JP | 58-81435 | 6/1983 |
| JP | 58-190367 | 12/1983 |
| JP | 1-256764 | 10/1989 |
| JP | 06-003323 | 1/1994 |
| JP | 06-137648 | 5/1994 |
| JP | 9-145174 | 6/1997 |
| JP | 2000-88406 | 3/2000 |
| JP | 2000-121177 | 4/2000 |

* cited by examiner

*Primary Examiner* — Frantz F Jules
*Assistant Examiner* — Daniel C Comings
(74) *Attorney, Agent, or Firm* — Wenderoth, Lind & Ponack, L.L.P.

(57) ABSTRACT

In a refrigeration unit including a variable performance compressor driven by an inverter motor, a sensor is configured to detect a physical amount corresponding to a refrigerant pressure on the high-pressure side of a refrigerant circuit. A measured value of the physical amount is compared with a first reference value corresponding to a first predetermined pressure of the refrigerant and a second reference value corresponding to a second predetermined pressure lower than the first predetermined pressure. A protective operation can start if the comparison result indicates that an actual refrigerant pressure is higher than the first predetermined pressure. The performance of the compressor can be gradually lowered if the comparison result indicates that an actual refrigerant pressure is between the first predetermined pressure and the second predetermined pressure.

26 Claims, 8 Drawing Sheets

REFRIGERATION UNIT HAVING VARIABLE PERFORMANCE COMPRESSOR OPERATED BASED ON HIGH-PRESSURE SIDE PRESSURE

CROSS REFERENCE TO RELATED APPLICATION

The present application is based on and incorporates herein by reference Japanese Patent Application No. 2005-82197 filed on Mar. 22, 2005.

BACKGROUND OF THE INVENTION

1. Field of the Invention

The present invention relates to a refrigeration unit that includes a variable performance compressor.

2. Description of the Related Art

A refrigeration unit having a variable performance compressor is commonly used for a refrigerator, a freezer, a vending machine, an ice maker, an air conditioner or the like, and the basic construction thereof is as follows. A compressor driven by an inverter motor, a condenser with a cooling fan, a throttle valve such as a capillary tube, and an evaporator, for example, are sequentially connected by a refrigerant circuit, in which a refrigerant is compressed by the compressor and thereafter cooled through the condenser, so that a cooling action is performed through the evaporator by vaporizing the refrigerant.

Generally, in the refrigeration unit of this type, the devices on the refrigerant circuit may be damaged if the pressure in the refrigerant circuit increases too much. Therefore, as shown in JP-B-H06-3323, for example, the refrigerant pressure is detected directly or indirectly, and a protective operation, which halts the compressor or lowers the performance thereof to a predetermined level, is performed immediately after the detected pressure exceeds a predetermined limit value.

However, a problem arises that a refrigeration unit is prone to perform the above protective operation at short intervals when it is used in a harsh environment (e.g., for industrial use).

In an industrial refrigerator installed in the kitchen of a restaurant, for example, its doors are frequently opened at lunch or dinner time and thereby the thermal load rapidly increases such that the refrigeration unit continuously operates on full power. Additionally, a number of thermal sources such as cooking stoves exist in the kitchen and thereby the ambient temperature easily rises. In these circumstances, the condenser is prone to degrade in its heat discharge.

The applicant actually measured the ambient temperature concerning an industrial refrigerator installed in the kitchen of a restaurant as an example. Many cooking stoves in the kitchen were ignited during a busy time, and then the temperature in the circumference of the condenser (generally disposed on the top of the heat insulating box) of the refrigeration unit immediately began to rise. It reached about 45° C. on average, especially in the summer, and temporarily reached 50-60° C.

In such an environment, the pressure of the high-pressure side of the refrigerant circuit is projected to be extremely high, and therefore the protective operation for the refrigeration unit is performed at short intervals. Consequently, the temperature inside the refrigerator rises, and food or the like inside the refrigerator may lower in quality.

To address the above circumstances, the refrigeration unit may be designed to be tolerant of high pressure by employing high-pressure-tolerant parts as components thereof. However, such parts are very expensive, and it costs a great deal to do a test for proving design changes in this case.

SUMMARY OF THE INVENTION

The present invention was made in view of the forgoing circumstances, in order to provide a refrigeration unit capable of sufficiently protecting itself, without employing high-pressure-tolerant components, from high pressure therein suppressing temperature rise inside the refrigerator at the time of rapid pressure rise.

A refrigeration unit according to the present invention can include a refrigerant circuit formed by sequentially connecting a variable performance compressor, a condenser, a throttle valve and an evaporator. A refrigerant in the refrigerant circuit is compressed by the compressor and thereafter cooled through the condenser, so that a cooling action is performed through the evaporator by vaporizing the refrigerant. The refrigeration unit further includes a sensor configured to detect a physical amount corresponding to a refrigerant pressure on the high-pressure side of the refrigerant circuit, a comparator configured to compare a measured value of the physical amount with a first reference value and a second reference value, and a compressor controller configured to start a protective operation for the refrigeration unit or gradually lowering the performance of the compressor based on the comparison result from the comparator.

The first reference value can correspond to a first predetermined pressure of the refrigerant, and the second reference value can correspond to a second predetermined pressure lower than the first predetermined pressure. The compressor controller signals a protective operation to run when it is determined based on the comparison result that an actual refrigerant pressure is higher than the first predetermined pressure. The compressor controller lowers the performance of the compressor when it is determined based on the comparison result that an actual refrigerant pressure is between the first and second predetermined pressures.

The present invention can also include a protective duration accumulating timer configured to determine the time elapsed after the protective operation is started. The compressor controller discontinues the protective operation when the protective duration accumulating timer reaches a predetermined time.

Conventionally, a protective operation for halting the compressor or lowering the performance thereof to a predetermined level is performed immediately after the refrigerant pressure exceeds the limit pressure against which the refrigeration unit is guaranteed. However, no problem arises if the refrigerant pressure actually exceeds the limit pressure only for a short time. Therefore the present invention can include a value corresponding to the above limit pressure for the second reference value, and another value for the first reference value corresponding to a higher pressure than the limit pressure.

Thus the performance of the variable performance compressor is first gradually lowered according to the present invention, if the refrigerant pressure in the refrigerant circuit increases and thereby exceeds the second predetermined pressure. In contrast, in conventional refrigerator circuits the compressor is immediately halted in the case described above.

According to the present invention, the refrigerant pressure gradually decreases while the performance of the compressor is gradually lowered, and if the pressure should fall to below the second predetermined pressure in a relatively short time, a normal state is restored. During this time, the refrigeration unit continues to fulfill its original function, because the compressor is not completely halted but its performance is gradually lowered until the refrigerant pressure falls to below the second predetermined pressure. Thus the temperature rise inside the refrigerator is prevented, and the food or the like can be safely stored.

In most cases, according to the above control, the excessive increase of the refrigerant pressure due to a thermal overload is prevented or reduced, and thereby the compressor is prevented from halting. However, in case of an abnormal state such as a failure of a cooling fan, the refrigerant pressure continues to increase, even if the performance of the compressor is lowered when the refrigerant pressure exceeds the second predetermined pressure.

In this case, according to the present invention, the compressor is halted or limited to a safety operation rate (i.e., the protective operation is performed), when the refrigerant pressure exceeds the first predetermined pressure. Thus the refrigeration unit according to the present invention ensures protection thereof maintaining its original function when the refrigerant pressure increases due to a thermal overload.

BRIEF DESCRIPTION OF THE DRAWINGS

Features and advantages of the present invention will become more apparent from the following detailed description made with reference to the accompanying drawings. In the drawings.

DETAILED DESCRIPTION OF THE PRESENT INVENTION

The present invention will be described hereinafter with reference to embodiments and modifications.

First Embodiment

A first embodiment of the present invention will be explained with reference to FIGS. 1 through 6, in which the present invention is applied to an industrial refrigerator-freezer.

Figure 1:
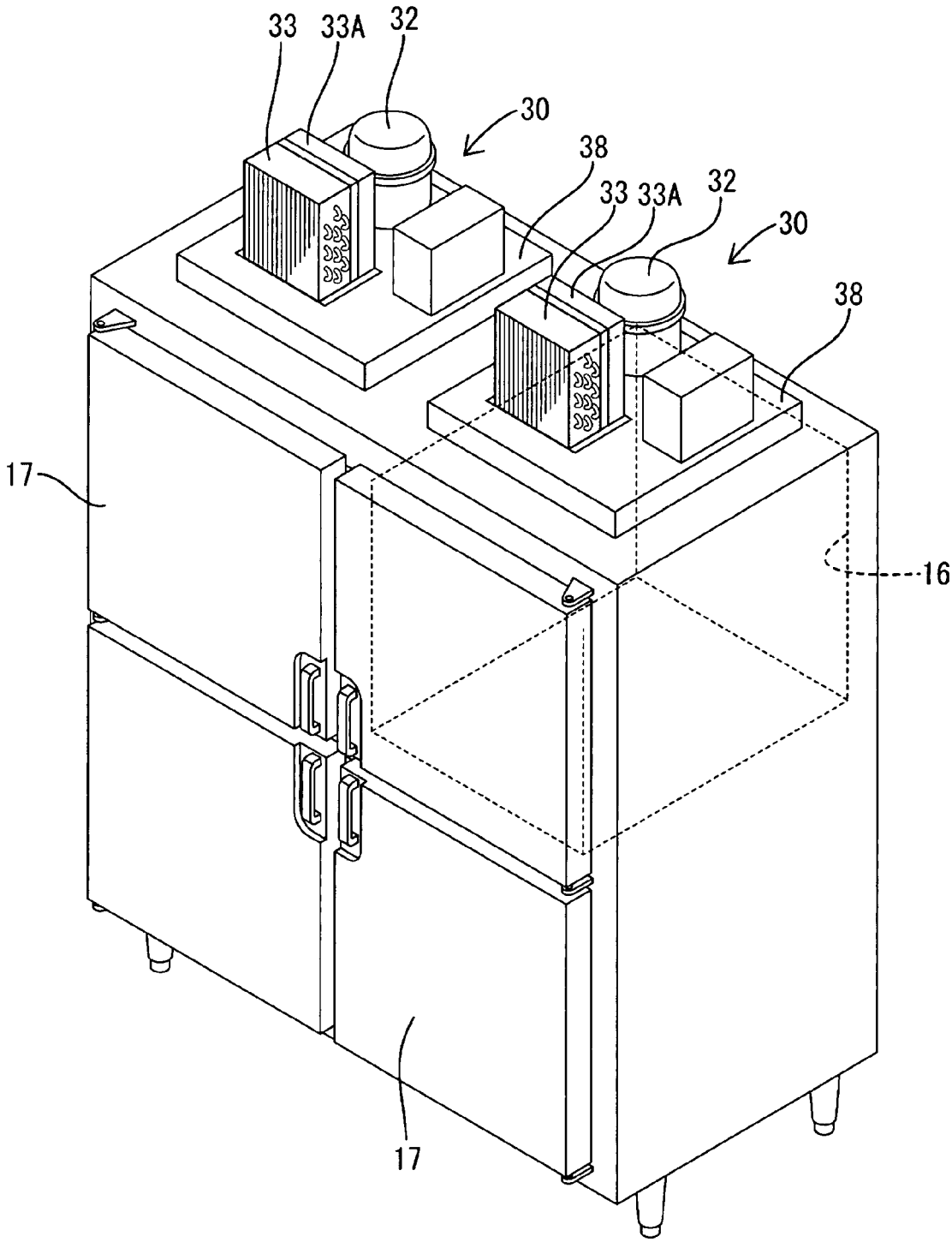
FIG. 1 is a perspective view of a refrigerator-freezer according to a first embodiment of the present invention.
Figure 2:
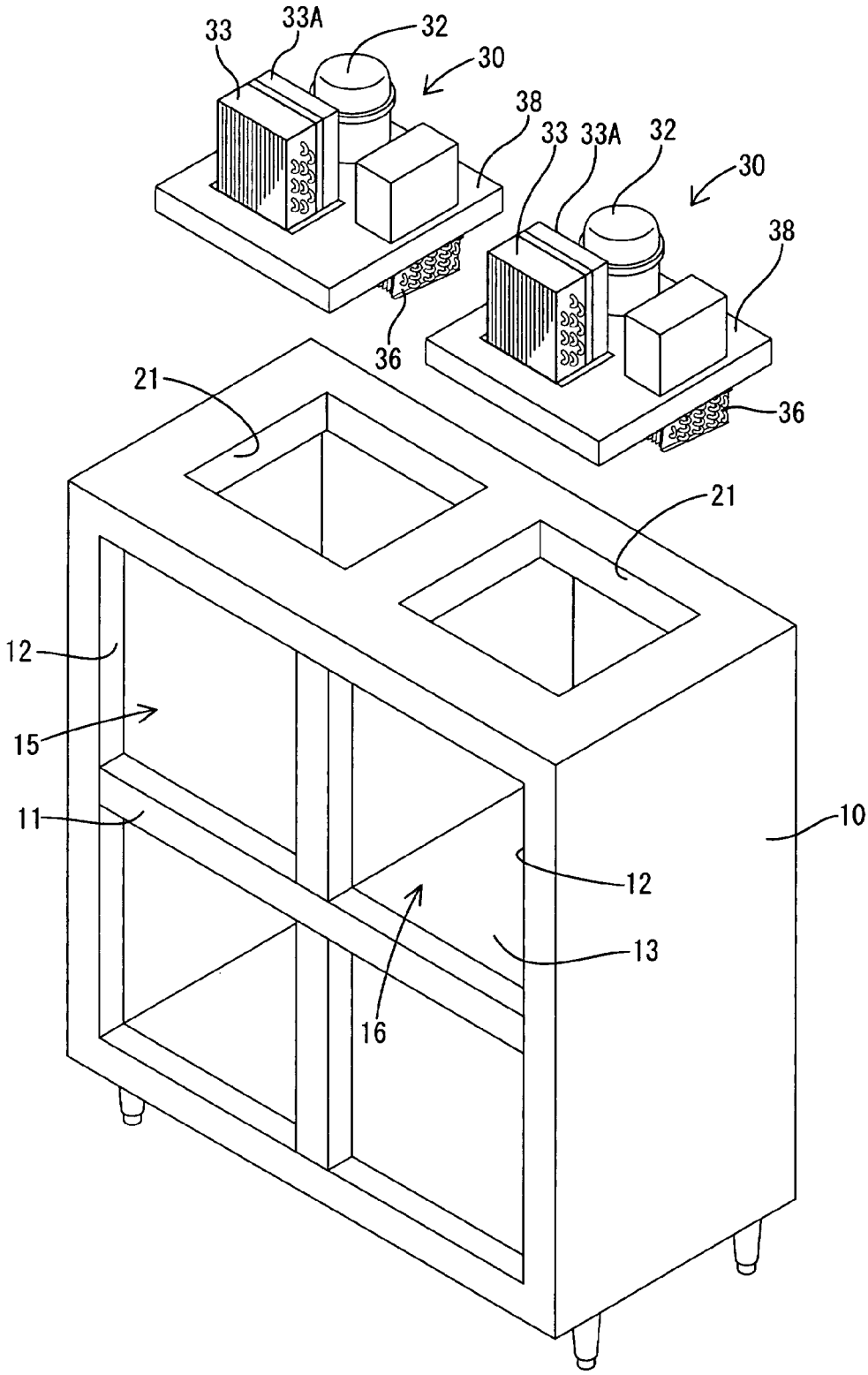
FIG. 2 is an exploded perspective view of the refrigerator-freezer shown in FIG. 1.

Referring to FIGS. 1 and 2, the refrigerator-freezer according to the present embodiment is a four-door type, and includes a body 10 formed of a heat insulating box having the open front as shown in FIGS. 1 and 2. The front opening is divided into four access openings 12 by a cruciform partition frame 11. The inner space is divided by a heat insulating wall 13, and thereby a freezer compartment 16 as a storage room is formed of substantially a quarter of the inner space corresponding to the upper-right access opening 12 viewed from the front. The remaining three quarters of the inner space form a refrigerator compartment 15 also as a storage room. Heat insulating doors 17 are pivotally mounted to the front of the heat insulating box so as to open and close the respective access openings 12.

Figure 4:
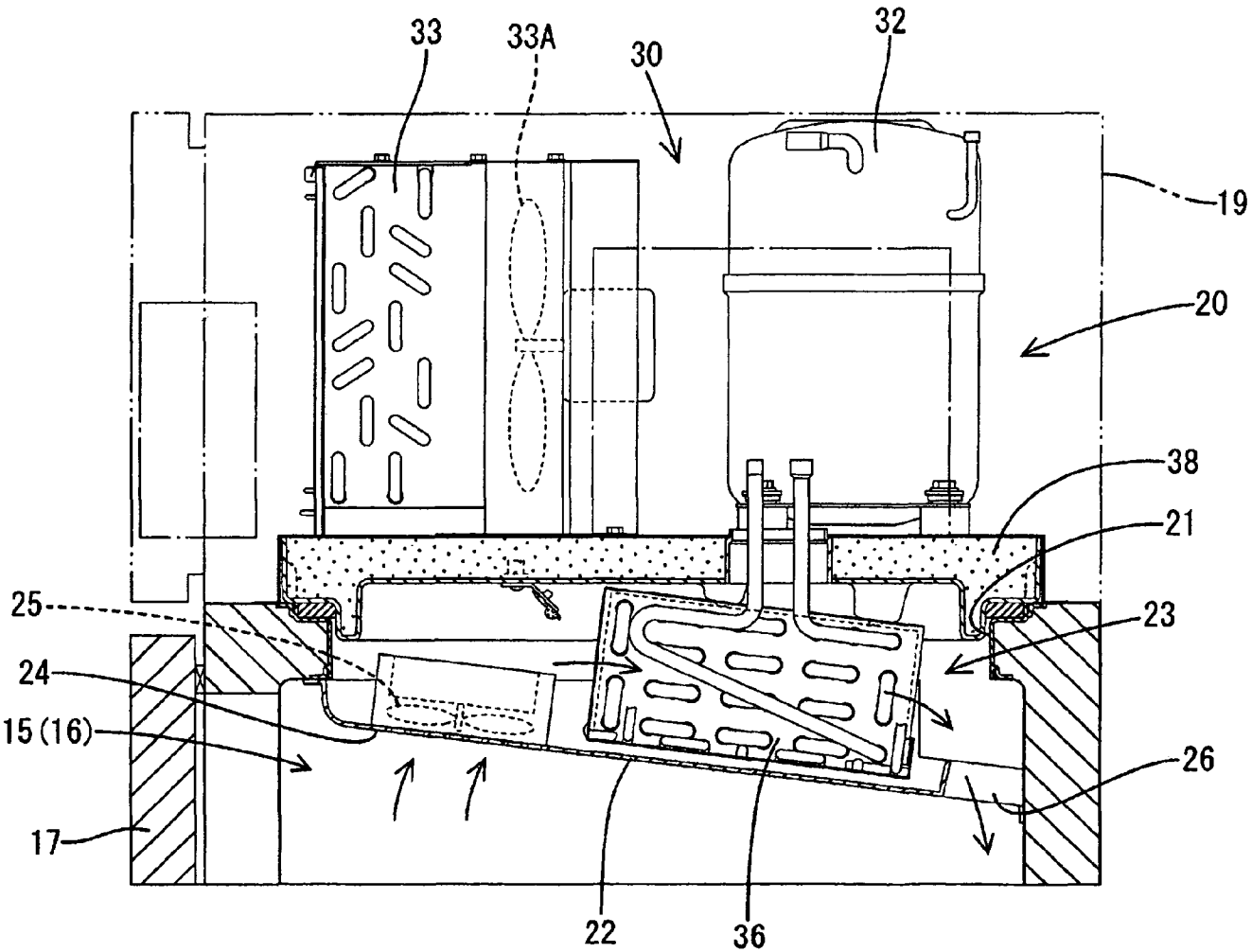
FIG. 4 is a partial cross sectional view of a refrigeration unit installed on the refrigerator-freezer.

An equipment compartment 20 is defined on the top of the body 10 by panels 19 erected around the top of the body 10 as shown in FIG. 4. Through the top of the body 10, which also serves as the bottom of the equipment compartment, rectangle openings 21 of the same size are formed corresponding to the respective ceilings of the refrigerator and freezer compartments 15 and 16. A refrigeration unit 30 as a single unit is mounted individually to each of the openings 21.

Figure 3:
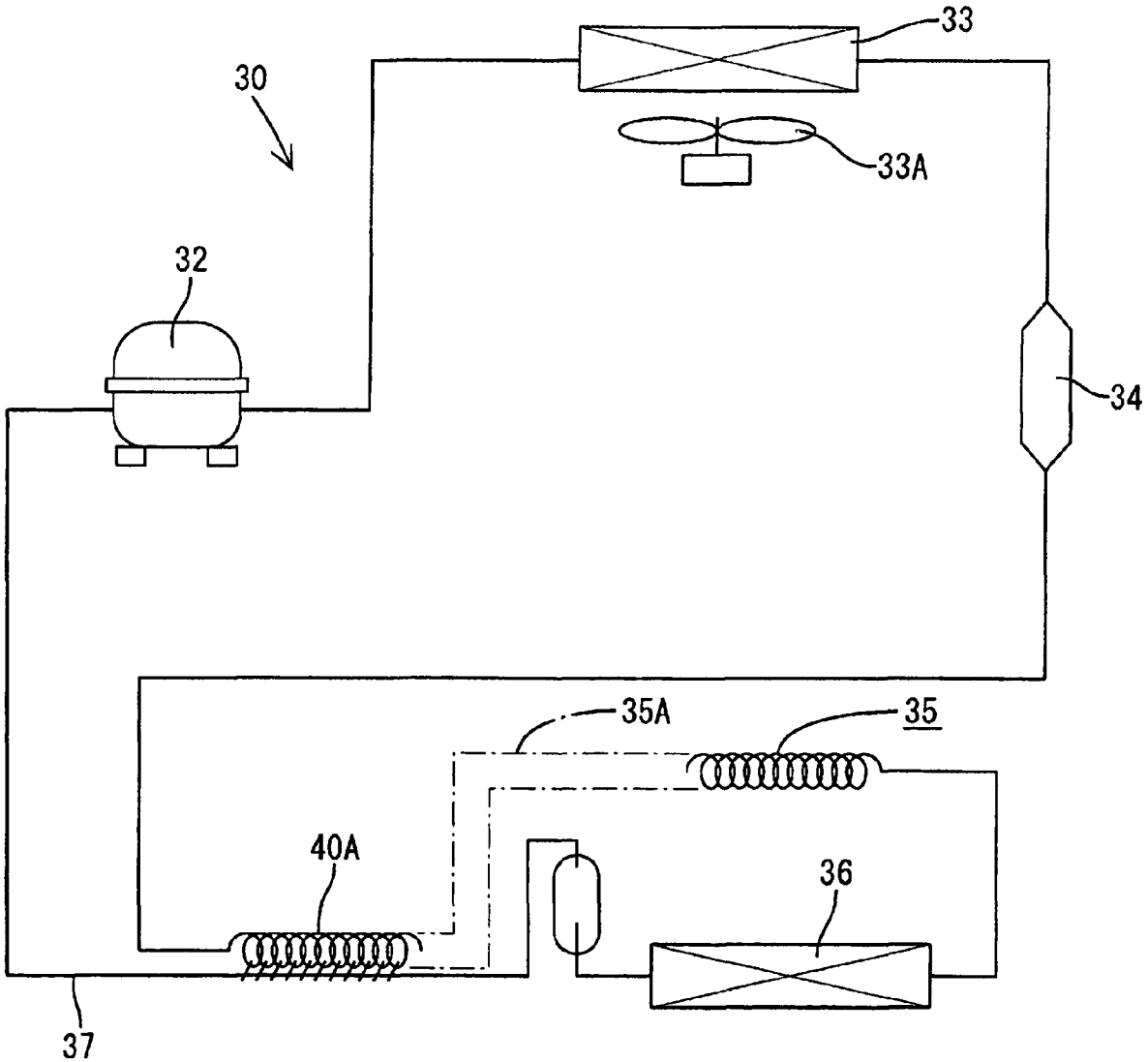
FIG. 3 is a diagram showing the construction of a refrigerant circuit.

Referring to FIG. 3, each refrigeration unit 30 includes a refrigerant circuit 37 formed by sequentially connecting a variable performance compressor 32 driven by an inverter motor, a condenser 33 with a condenser fan 33A, a dryer 34, a capillary tube 35 (corresponding to a throttle valve) and an evaporator 36. A refrigerant in the refrigerant circuit 37 is compressed by the compressor 32 and thereafter cooled into a liquid through the condenser 33, so that a cooling action is performed through the evaporator 36 by vaporizing the refrigerant.

Referring to FIG. 4 again, the refrigeration unit 30 includes a heat insulating unit mounting 38, which is positioned on the top of the body 10 so as to cover the opening 21. The evaporator 36 out of the components of the refrigeration unit 30 is mounted on the lower side of the unit mounting 38, while the other components are mounted on the upper side thereof.

As shown in FIG. 3, a predetermined inlet-side area of the spiral section 35A of the capillary tube 35 is soldered to the refrigerant piping of the refrigerant circuit 37 on the outlet side of the evaporator 36, so that a heat exchanger 40A is formed.

In the present embodiment, the position of the heat exchanger 40A on the whole capillary tube 35 is set in an area that is on the inlet side in relation to the starting point of vaporization of the liquid refrigerant and on the inlet-side half of the whole length of the capillary tube 35. Preferably the area is within the inlet-side one third (i.e., a region in which most of the refrigerant exits in liquid form) of the capillary tube 35. Thus the heat exchanger 40A of the capillary tube 35 is arranged on the inlet side, and the supercooled region is increased so that vaporization starting point shifts to the outlet side in the capillary tube 35. Consequently, reduction of the total resistance of the capillary tube 35 is achieved.

Returning to FIG. 4, a drain pan 22, which also serves as a cooling duct, is disposed on each of the ceiling of the refrigerator and freezer compartments 15 and 16 so as to inwardly decline toward the back side of the compartment 15, 16. An evaporator compartment 23 is formed between the drain pan 22 and the unit mounting 38. An inlet port 24 is formed through and a cooling fan 25 is disposed on the upper portion of the drain pan 22, while an outlet port 26 is formed through the lower portion thereof.

Basically, air in the refrigerator compartment 15 (freezer compartment 16) is drawn into the evaporator compartment 23 through the inlet port 24 as shown by the arrows in FIG. 4, when the refrigeration unit 30 and the cooling fan 25 are activated. Then the air passes through the evaporator 36, during which the air is transformed into cool air through heat exchange. The cool air is sent into the refrigerator compartment 15 (freezer compartment 16) from outlet port 26. Thus the air is circulated, and thereby the air in the refrigerator compartment 15 (freezer compartment 16) is cooled.

Figure 5:
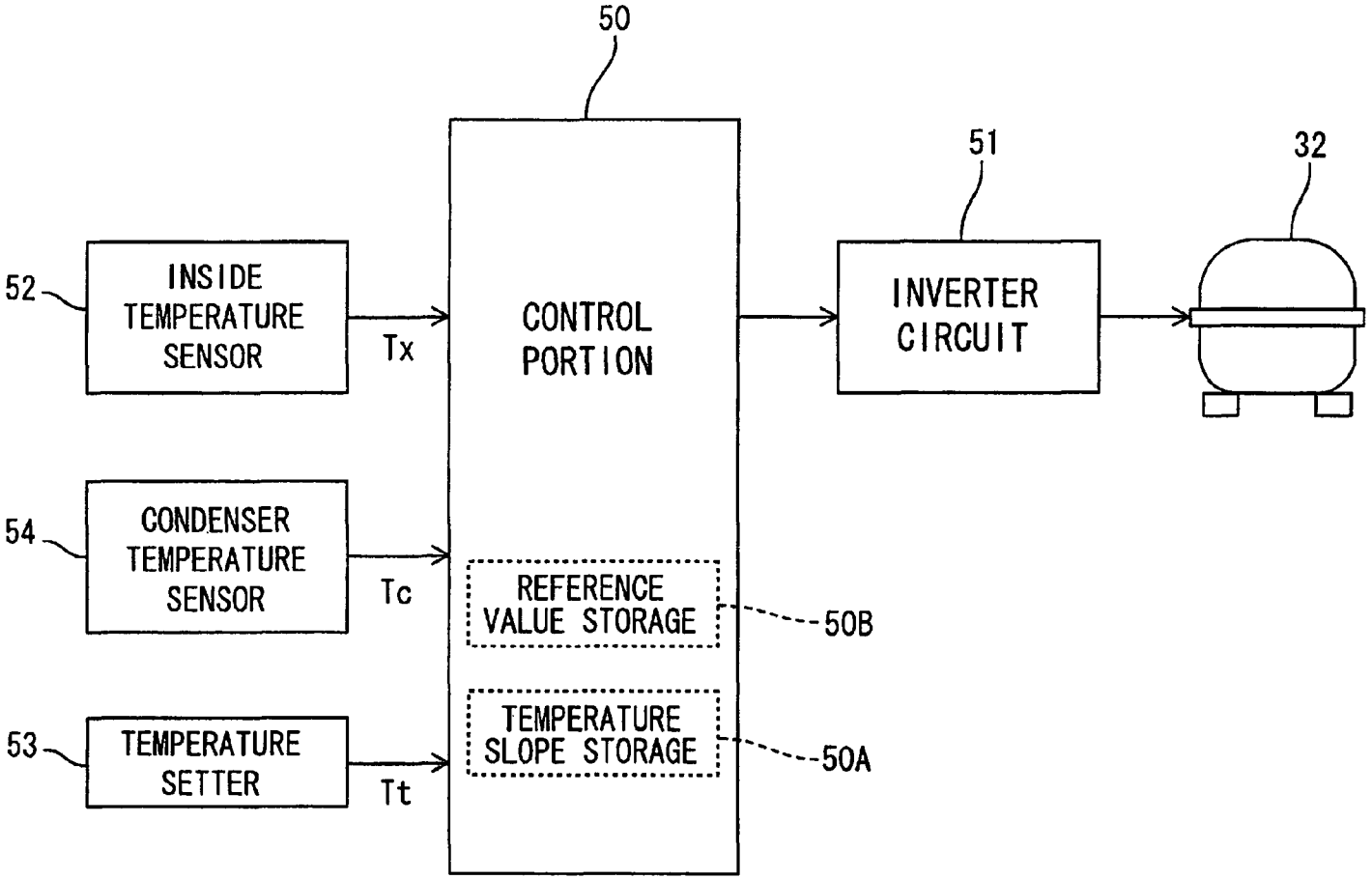
FIG. 5 is a block diagram showing a control portion and the related components.

Referring to FIG. 5, a control portion 50 including a microcomputer (not shown) is provided for controlling the refrigeration unit 30. The control portion 50 can control the output frequency of an inverter circuit 51, which in turn activates the motor incorporated in the compressor 32. In the present embodiment, the output frequency of the inverter circuit 51 is controlled so that the compressor 32 operates at a rotational speed out of predetermined rotational speed levels which are between 30 rps and 76 rps and of predetermined rotational speed intervals.

A signal from an inside temperature sensor 52 disposed in the refrigerator compartment 15 (freezer compartment 16) is provided for the control portion 50. The microcomputer of the control portion 50 controls the inverter circuit 51 based on the signal from the inside temperature sensor 52. More specifically, the inverter circuit 51 is activated so that the compressor 32 operates, when the inside temperature Tx is equal to or higher than a target temperature Tt which is preset via a temperature setter 53. The inverter circuit 51 is deactivated so that the compressor 32 halts, when the inside temperature Tx is lower than the target temperature Tt.

The actual refrigerating operation (i.e., activation of the compressor 32) is performed as follows. The target refrigerating curves (i.e., target slopes of refrigerating temperature) corresponding to the respective actual inside temperatures Tx are determined beforehand, and stored in a temperature slope storage 50A of the memory in the control portion 50. The microcomputer calculates an actual downslope ΔTx of the inside temperature Tx based on the signal from the inside temperature sensor 52, and compares the downslope ΔTx with the target slope ΔTt corresponding to the actual inside temperature Tx.

If the actual downslope ΔTx is more gradual than the target slope ΔTt, the microcomputer instructs the inverter circuit 51 to increase the output frequency so that the rotational speed of the compressor 32 is increased. Thus the refrigerating performance of the refrigeration unit 30 is raised. If the actual downslope ΔTx of the inside temperature Tx is more steep than the target slope ΔTt, the rotational speed of the compressor 32 is decreased so that the refrigerating performance of the refrigeration unit 30 is lowered.

On the other hand, the temperature Tc of the center of the condenser 33 is employed as a physical amount corresponding to the refrigerant pressure on the high-pressure side of the refrigerant circuit 37 of the refrigeration unit 30 in the present embodiment, and therefore a condenser temperature sensor 54 for detecting the temperature Tc is provided. The condenser temperature sensor 54 of the present embodiment corresponds to a sensor and a temperature sensor of the present invention.

In a reference value storage 50B of the memory of the control portion 50, a first reference value Tr1 (e.g., 78° C. as a condenser temperature) and a second reference value Tr2 (e.g., 73° C. as a condenser temperature) are stored. The first reference value Tr1 corresponds to a first predetermined pressure of the refrigerant, in response to which a protective operation such as halting of the compressor 32 should be performed for the refrigerant circuit 37. The second reference value Tr2 corresponds to a second predetermined pressure lower than the first predetermined pressure. The microcomputer of the control portion 50 functions as a comparator of the present invention, which obtains a signal from the condenser temperature sensor 54 and then compares the signal with the reference values Tr1, Tr2.

Figure 6:
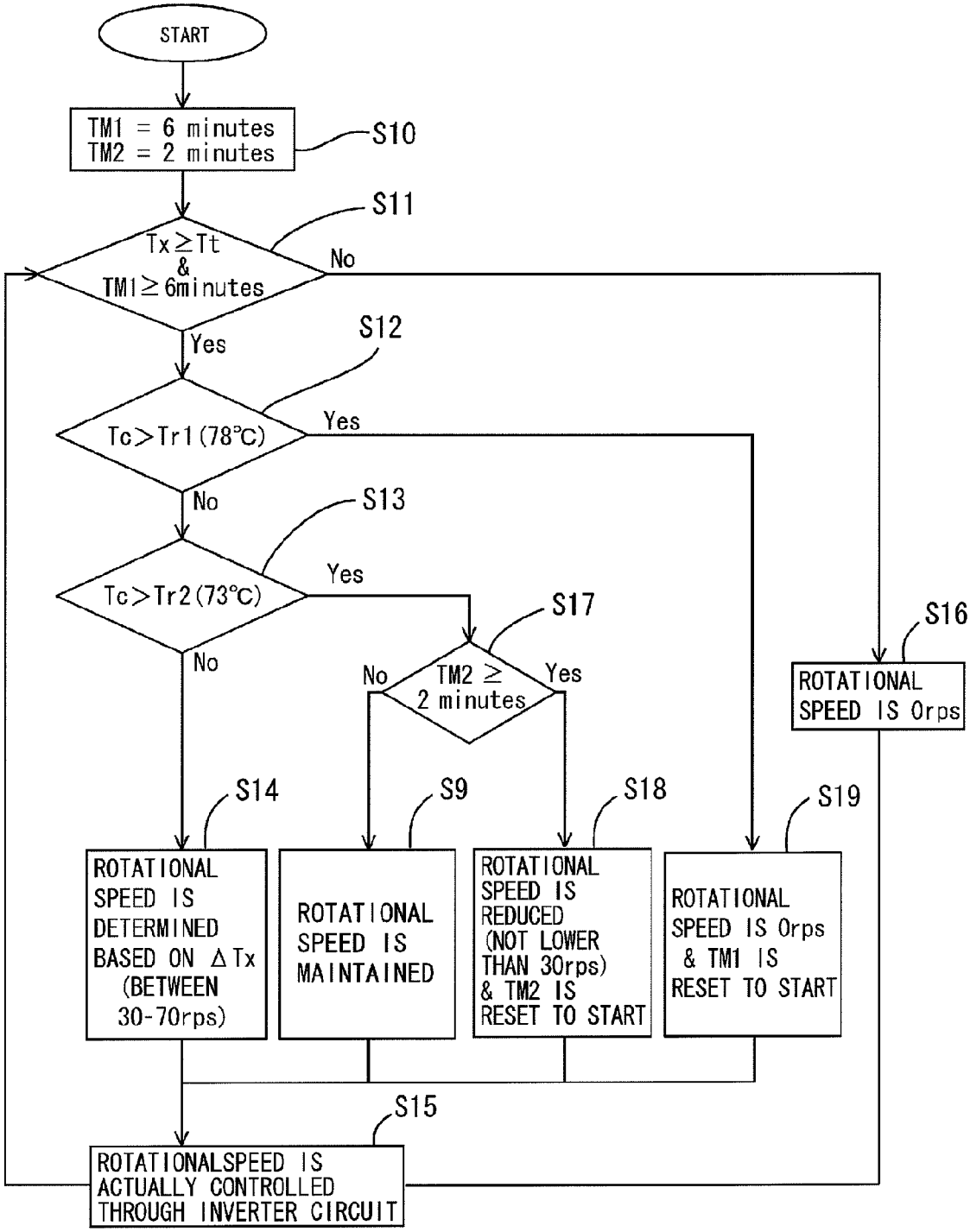
FIG. 6 is a flowchart of a controlled refrigerating operation according to the first embodiment.

Next, the operation of the refrigeration unit 30 according to the present embodiment will be explained with a central focus on a controlled refrigerating operation for maintaining the inside temperature around the target temperature. FIG. 6 is a flowchart of a software-related part of the controlled refrigerating operation performed by the control portion 50 according to the present embodiment. The following explanation also shows how the control portion 50 functions as a compressor controller of the present invention.

When the control transfers to the controlled refrigerating operation, a protective duration accumulating timer TM1 (corresponding to a protective duration accumulating timer of the present invention) for measuring a protective duration is first set to the threshold value (e.g., 6 minutes) at step S10. Further a step-down timer TM2 for measuring a step-down interval is also set to the threshold value (e.g., 2 minutes) at step S10. Then the process proceeds to step S11, and thus enters an inside temperature monitoring loop.

At step S11, it is determined whether the inside temperature Tx is equal to or higher than the target temperature Tt, which is a preset temperature set via the temperature setter 53, and the value of the protective duration accumulating timer TM1 is equal to or larger than 6 minutes.

This is the first time step S11 is executed, and therefore the value of the protective duration accumulating timer TM1 is equal to 6 minutes since it is set to 6 minutes at step S10. For this reason, the process proceeds to step S16, if the inside temperature Tx is lower than the target temperature Tt (i.e., No at step S11). The rotational speed of the compressor 32 is set to 0 rps at step S16, and the compressor 32 is actually controlled at step S15 based on the result of step S16. Thus the compressor 32 is deactivated or halted in this case. Thereafter the process returns to step S11.

On the other hand, if the inside temperature Tx is equal to or higher than the target temperature Tt (i.e., Yes at step S11), the process proceeds to step S12. At steps S12 and S13, it is determined whether the condenser temperature Tc exceeds the first reference value Tr1 (78° C.) and the second reference value Tr2 (73° C.) respectively.

When the controlled refrigerating operation is normally performed and thermal load is within a proper range (i.e., No at both of steps S12 and S13), the process proceeds to step S14. At step S14, the output frequency of the inverter circuit 51 (i.e., the rotational speed of the compressor 32) is determined based on the downslope ΔTx of the actual inside temperature Tx as described above.

Specifically, the downslope ΔTx of the actual inside temperature Tx is compared with the target slope ΔTt of the refrigerating temperature. If the difference between the two is within a predetermined range, that is, the two are approximately the same, it is determined that the actual decline of the inside temperature Tx is proper. In this case, the rotational speed of the compressor 32 is determined so as to maintain at the current rotational speed level. Note that the rotational speed is set to the minimum level (e.g., 30 rps) if the current rotational speed is 0 rps.

If the actual downslope ΔTx is larger than the target slope ΔTt, it is determined that the actual decline of the inside temperature Tx is too rapid. Therefore, in this case, the rotational speed of the compressor 32 is determined so as to reduce from the current rotational speed level to the immediate lower level with limits of not lower than 30 rps. Note that the rotational speed is set to the minimum level if the current rotational speed is 0 rps.

If the actual downslope ΔTx is less than the target slope ΔTt, it is determined that the actual decline of the inside temperature Tx is too slow. Therefore the rotational speed of the compressor 32 is determined so as to rise from the current rotational speed level to the immediate higher level with limits of not higher than 76 rps. Note that the rotational speed is set to the default level (e.g., 50 rps) if the current rotational speed is 0 rps. The rotational speed of the compressor 32 is actually controlled at step S15 based on the result of step S14, and thereafter the process returns to step S11.

Thus steps S11 thorough S15 are iterated so that the controlled refrigerating operation is performed. If the inside temperature Tx gradually decreases due to the controlled refrigerating operation and thereby 'Tx≧Tt' is not satisfied (i.e., No at step S11), the compressor 32 is halted at steps S16 and S15.

Assume that thermal load on the refrigeration unit 30 has increased rapidly. One reason could be ambient temperature rise due to cooking stoves, or inside temperature rise due to the doors 17 of the refrigerator compartment 15 (freezer compartment 16) being frequently opened during a busy time for a restaurant. Then the refrigerant pressure in the refrigerant circuit 37 increases, and the temperature Tc of the condenser 33 also rapidly rises. As a result, the process reaches step S17, when the temperature Tc exceeds the second reference value, that is, Yes at step S13.

At step S17, it is determined whether the value of the step-down timer TM2 is equal to or larger than 2 minutes. Since the step-down timer TM2 is initially set to 2 minutes at step S10 and thereafter not started, that is, Yes at step S17, the process proceeds to step S18. At step S18, the rotational speed of the compressor 32 is determined so as to reduce from the current rotational speed level to the immediate lower level with limits of not lower than 30 rps, and the step-down timer TM2 is reset to start. Note that the rotational speed of the compressor 32 is set to the minimum level if the current rotational speed is 0 rps. The rotational speed of the compressor 32 is actually controlled at step S15 based on the result of step S18, and then the process returns to step S11.

Thereafter the process likely proceeds from step S11 to step S12, and further to step 13 if No at step 12, that is, the condenser temperature Tc does not exceed the first reference value Tr1. Then the process likely proceeds to step S17, since the condenser temperature Tc may remain higher than the second reference value Tr2. At step S17, it is determined whether the value of the step-down timer TM2 is equal to or larger than 2 minutes. The process proceeds to step S9, since the step-down timer TM2 should not have reach 2 minutes yet. The rotational speed of the compressor 32 is determined at step S9 so as to maintain at the current rotational speed level. Note that the rotational speed of the compressor 32 is set to the minimum level if the current rotational speed is 0 rps.

The rotational speed of the compressor 32 is actually controlled at step S15 based on the result of the step S9. Then process returns to step S11. Thus steps S11-S13, S17, S9, S15 are iterated unless the condenser temperature Tc exceeds the first reference value Tr1.

Two minutes after the rotational speed is previously reduced, the process reaches step S18 (because of "Yes" at step S17), if the condenser temperature Tc remains between the first reference value Tr1 and the second reference value Tr2. The rotational speed of the compressor 32 is determined at step S18 so as to reduce from the current rotational speed level to the immediate lower level again, and actually controlled at step S15 based on the result of step S18. Thereafter the process returns to step S11.

Thus the rotational speed of the compressor 32 is reduced to the immediate lower level every two minutes (i.e., the performance of the compressor 32 is gradually lowered), as long as the condenser temperature Tc is between the first reference value Tr1 and the second reference value Tr2. Thereby the refrigerant pressure gradually decreases, and the condenser temperature Tc falls to below the second reference value Tr2 in a relatively short time. Thus the normal state is restored.

According to the present embodiment, the compressor 32 is not halted or its performance is not rapidly lowered, even if the refrigerant unit 30 rapidly transfers to a thermal overload state. In this case, the performance of the compressor 32 is gradually lowered as described above and thereby the refrigerating operation is continued, so that the rise in the inside temperature Tx is suppressed. Therefore food, or the like, can be safely stored to maintain quality, if the condenser temperature Tc temporarily exceeds the second reference value Tr2.

In most cases, halting of the compressor 32 due to pressure increase in the refrigerant can be prevented by gradually lowering the performance of the compressor 32 after the condenser temperature Tc exceeds the second reference value Tr2 as described above.

However, the condenser temperature Tc may exceed the first reference value Tr1, if a thermal overload state such as an abnormally high temperature around the refrigerator continues to some extent. In this case, returning to FIG. 6, the process reaches step S19, when the condenser temperature Tc exceeds the first reference value Tr1, that is, Yes at step S12. At step 19, the rotational speed of the compressor 32 is set to 0 rps, so that the compressor 32 is halted or deactivated for surely protecting the refrigeration unit 30. Further the protective duration accumulating timer TM1 is reset to start at step 19. The deactivation of the compressor 32 at step S19 corresponds to a protective operation of the present invention.

The rotational speed of the compressor 32 is actually controlled at step S15 based on the result of step S19. Thereafter the process returns to step S11.

Then the process likely proceeds to step S16 from step S11, because the protective duration accumulating timer TM1 is just started and therefore the value thereof should be less than 6 minutes (i.e., No at step S11). Thus the deactivation of the compressor 32 is continued for a predetermined time (6 minutes in the present embodiment). When 6 minutes have elapsed after the compressor 32 is forcibly halted, the process proceeds from step 11 to step S12 if the inside temperature Tx is equal to or higher than the target temperature Tt (i.e., Yes at step S11). Thus the controlled refrigerating operation is automatically resumed, so that food, or the like, in the refrigerator is protected. The predetermined time (e.g., 6 minutes) of the present embodiment corresponds to a second predetermined time of the present invention.

However, the refrigerant pressure should continue to increase in the event of a failure of the condenser fan 33A of the condenser 33, for example. In this case, the process reaches step S19 again, since the condenser temperature Tc still exceeds the first reference value Tr1, that is, Yes at step S12. Then the compressor 32 is deactivated for 6 minutes again.

The effects of the present embodiment are as follows. In the present embodiment, the second reference value Tr2 is set to a value corresponding to a limit pressure, in response to which the protective operation is conventionally performed, as described above. The first reference value Tr1 is set to a value corresponding to a higher pressure than the limit pressure. This is desirable because the refrigeration unit 30 properly operates through a brief state of the conventional limit pressure. Further, in the case of a pressure test on the compressor 32 such as a wear test on the shaft thereof, a short-term pressure test can be relatively easily performed.

In most cases, halting of the compressor 32 due to pressure increase in the refrigerant can be prevented by gradually lowering the performance of the compressor 32 after the condenser temperature Tc exceeds the second reference value Tr2. Thus the refrigerating operation is continued even when the thermal load on the refrigeration unit 30 rapidly increases, so that the rise in the inside temperature Tx is suppressed.

However, the condenser temperature Tc may exceed the first reference value Tr1, if a thermal overload state (such as an abnormally high temperature around the refrigerator) continues to some extent. In this case, according to the present embodiment, the compressor 32 is deactivated for a predetermined time and thereby the refrigeration unit 30 is surely protected.

According to the present embodiment, the compressor 32 is automatically restored to operation when the situation allows, even if it is halted or deactivated for protecting the refrigeration unit 30. The reason that the measured value of the refrigerant pressure exceeds the first reference value Tr1 is not always a failure of the condenser fan 33A or the like, but may be a temporal overload or the like.

Therefore the refrigeration unit 30 can include a protective duration accumulating timer TM1 configured to determine the time during the protective operation, and a control portion 50 (as the compressor controller) configured to discontinue the protective operation based on the accumulated time. The control portion 50 discontinues the protective operation, if the measured value of the refrigerant pressure decreases to the first reference value Tr1 when the time accumulated by the protective duration accumulating timer TM1 reaches a predetermined time (e.g., 6 minutes).

Thus the compressor 32 may be automatically restored when the predetermined time elapsed after the protective operation is started, so that the original function (e.g., cold storage function for food or the like) of the refrigeration unit 30 is interrupted as little time as possible.

Second Embodiment

Figure 7:
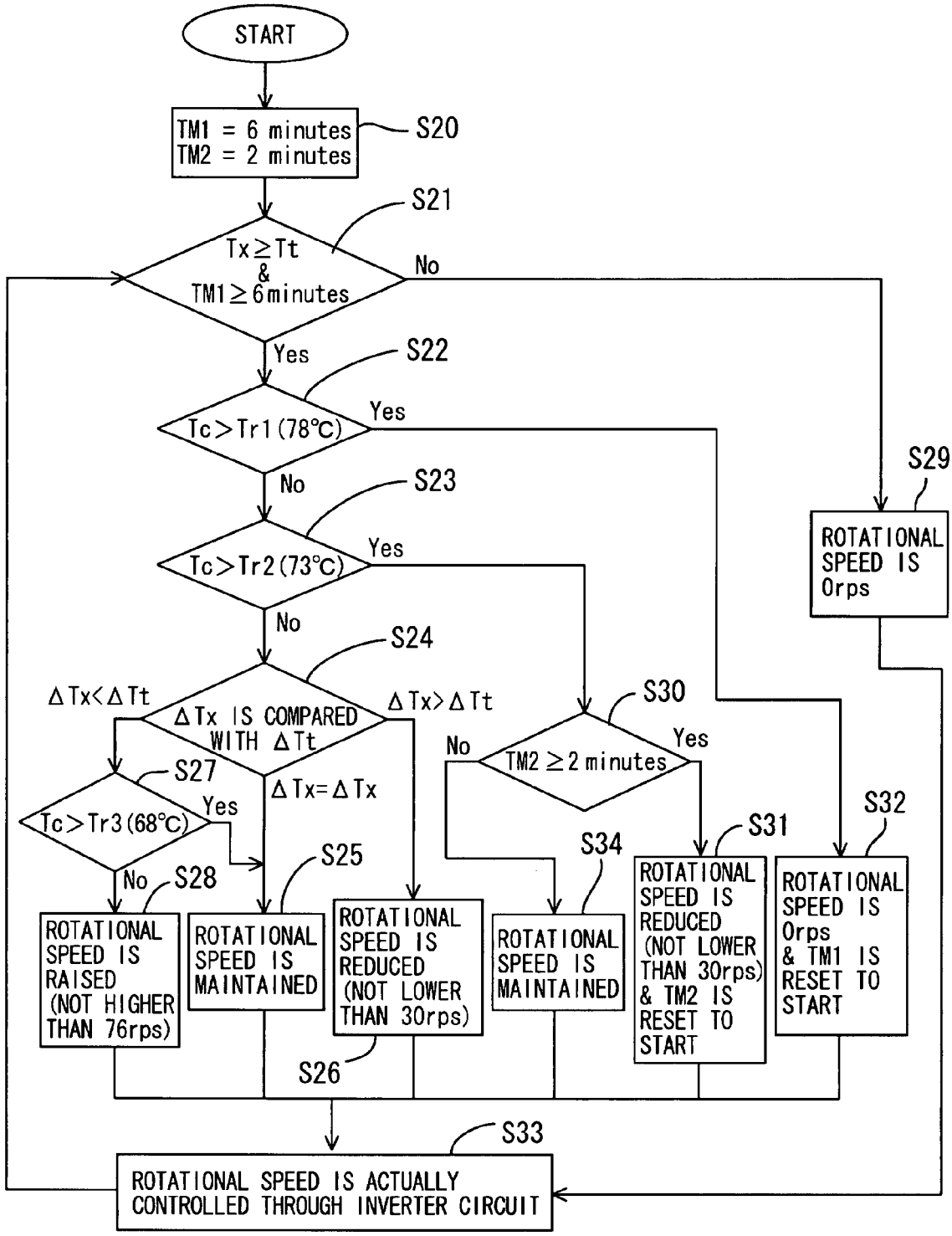
FIG. 7 is a flowchart of a controlled refrigerating operation according to a second embodiment.

FIG. 7 is a flowchart of a software-related part of a controlled refrigerating operation performed by a control portion of a refrigeration unit according to a second embodiment of the present invention. The other constructions of the present embodiment are similar to the above first embodiment. Therefore, in the following explanation, the same or similar constructions are designated by the same symbols as the first embodiment, and redundant explanation is omitted.

In the above first embodiment, the control portion 50 (as the comparator) compares the measured condenser temperature Tc with the first and second reference values Tr1, Tr2. In contrast to this, according to the present embodiment, a third reference value Tr3, which is set to a value corresponding to a third predetermined pressure lower than the second predetermined pressure corresponding to the second reference value Tr2, is additionally employed. The third reference value Tr3 can be set, for example, to 68° C. as a condenser temperature Tc in the present embodiment.

Referring to FIG. 7, when the control transfers to the controlled refrigerating operation, a protective duration accumulating timer TM1 and a step-down timer TM2 are set to the respective threshold value at the initialization step S20. Then the process proceeds to step S21, and thus enters an inside temperature monitoring loop. At step S21, it is determined whether the inside temperature Tx is equal to or higher than the target temperature Tt, which is set via a temperature setter 53, and the value of the protective duration accumulating timer TM1 can be equal to or larger than 6 minutes.

If the inside temperature Tx is lower than the target temperature Tt, the process proceeds to step S29 and then the compressor 32 is deactivated or halted at steps S29 and S33 similarly to the first embodiment. Thereafter the process returns to step S21

On the other hand, if the inside temperature Tx is equal to or higher than the target temperature Tt, the process proceeds to step S22. At steps S22 and S23, it is determined whether the condenser temperature Tc exceeds the first reference value Tr1 and the second reference value Tr2 respectively.

When the controlled refrigerating operation is normally performed and thermal load is within a proper range (i.e., No at both of steps S22 and S23), the process proceeds to step S24. At step S24, the downslope ΔTx of the actual inside temperature Tx is compared with the target slope ΔTt of the refrigerating temperature. If the difference between the two is within a predetermined range, that is, the two are approximately the same, it is determined that the actual decline of the inside temperature Tx is proper. In this case, the rotational speed of the compressor 32 is determined at step S25 so as to maintain at the current rotational speed level. Note that the rotational speed is set to the minimum level if the current rotational speed is 0 rps.

If the actual downslope ΔTx is larger than the target slope ΔTt, it is determined that the actual decline of the inside temperature Tx is too rapid. Therefore the rotational speed of the compressor 32 is determined at step S26 so as to reduce from the current rotational speed level to an immediate lower level with limits of not lower than 30 rps in this case. Note that the rotational speed is set to the minimum level if the current rotational speed is 0 rps.

If the actual downslope ΔTx is less than the target slope ΔTt, it is determined that the actual decline of the inside temperature Tx is too slow. Therefore the rotational speed of the compressor 32 is determined at step S28 so as to increase from the current rotational speed level to the immediate higher level with limits of not higher than 76 rps, if the condenser temperature Tc does not exceed the third reference value Tr3 (that is, No at step S27). Note that the rotational speed is set to the default level (e.g., 50 rps) if the current rotational speed is 0 rps. If Yes is determined at step S27, the rotational speed of the compressor 32 is determined at step S25 so as to maintain at the current rotational speed level as will hereinafter be described in detail.

The rotational speed of the compressor 32 is actually controlled at step S33 based on the result of step S25, S26, or S28, and thereafter the process returns to step S21.

Thus, in the present embodiment, the performance of the compressor 32 is determined based on the downslope ΔTx of the inside temperature Tx, when the condenser temperature Tc is lower than the third reference value Tr3. In contrast, raising of the performance of the compressor 32 is stopped, when the condenser temperature Tc is between the third and second reference values Tr3 and Tr2.

The steps S21-S28, S33 are iterated so that the controlled refrigerating operation is performed. If the inside temperature Tx gradually decreases due to the controlled refrigerating operation and thereby 'Tx≧Tt' is not satisfied (i.e., No at step S21), the compressor 32 is halted at steps S29 and S33.

Assume that thermal load on the refrigeration unit 30 has increased rapidly. One reason could be ambient temperature rise due to cooking stoves, or inside temperature rise due to the doors 17 of the refrigerator compartment 15 (freezer compartment 16) being frequently opened during a busy time for a restaurant. Then the refrigerant pressure in the refrigerant circuit 37 increases, and the temperature Tc of the condenser 33 also rapidly rises.

When the condenser temperature Tc accordingly exceeds the third reference value (that is, Yes at step S27), the raising of the performance of the compressor 32 is stopped even if the downslope ΔTx of the inside temperature Tx is relatively gradual.

In this case, the rotational speed of the compressor 32 is determined at step S25 so as to maintain at the current rotational speed level as described above. That is, the rotational speed of the compressor 32 can be maintained or lowered depending on the actual downslope ΔTx of the inside temperature ΔTx, when the condenser temperature Tc exceeds the third reference value Tr3. Thereby the refrigerant pressure should also be maintained or lowered.

Nevertheless, the refrigerant pressure may further increase. In this case, the process reaches step S30, when the condenser temperature Tc exceeds the second reference value (that is, Yes at step S23). At step S30, it is determined whether the value of the step-down timer TM2 is equal to or larger than 2 minutes. Since the step-down timer TM2 is initially set to 2 minutes at step S20 and thereafter not started, that is, Yes at step S30, the process proceeds to step S31. At step S31, the rotational speed of the compressor 32 is determined so as to reduce from the current rotational speed level to the immediate lower level with limits of not lower than 30 rps, and the step-down timer TM2 is reset to start. Note that the rotational speed is set to the minimum level if the current rotational speed is 0 rps. The rotational speed of the compressor 32 is actually controlled at step S33 based on the result of step S31, and then the process returns to step S21.

Thereafter the process likely proceeds from step S21 to step S22, and further to step 23 if the condenser temperature Tc does not exceed the first reference value Tr1, that is, No at step 22. Then the process proceeds to step S30, if the condenser temperature Tc remains higher than the second reference value Tr2. At step S30, it is determined whether the value of the step-down timer TM2 is equal to or larger than 2 minutes. The process proceeds to step S34, since the step-down timer TM2 should not have reached 2 minutes yet. The rotational speed of the compressor 32 is determined at step S34 so as to maintain at the current rotational speed level. Note that the rotational speed is set to the minimum level if the current rotational speed is 0 rps. The rotational speed of the compressor 32 is actually controlled at step S33 based on the result of the step S34, and then process returns to step S21.

Thus steps S21-S23, S30, S34, S33 are iterated unless the condenser temperature Tc exceeds the first reference value Tr1. Two minutes after the rotational speed is previously reduced, the process reaches step S31 again since Yes at step S30, if the condenser temperature Tc remains between the first reference value Tr1 and the second reference value Tr2. The rotational speed is determined at step S31 so as to reduce from the current rotational speed level to the immediate lower level again with limits of not lower than 30 rps. The rotational speed of the compressor 32 is actually controlled at step S33 based on the result of step S31, and thereafter the process returns to step S21.

Thus the rotational speed of the compressor 32 is reduced to the immediate lower level every two minutes (i.e., the performance of the compressor 32 is gradually lowered), as long as the condenser temperature Tc is between the first reference value Tr1 and the second reference value Tr2. Thereby the refrigerant pressure gradually decreases, and the condenser temperature Tc falls to below the second reference value Tr2 in a relatively short time. Thus the normal state is restored.

According to the present embodiment, the compressor 32 is not halted or its performance is not rapidly lowered, even if the refrigerant unit 30 rapidly transfers to a thermal overload state. In this case, the performance of the compressor 32 is gradually lowered as described above and thereby the refrigerating operation is continued, so that the rise in the inside temperature Tx is suppressed. Therefore food, or the like, can be safely stored in order to maintain quality, if the condenser temperature Tc temporarily exceeds the second reference value Tr2.

In most cases, halting of the compressor 32 due to refrigerant pressure increase can be prevented by gradually lowering the performance of the compressor 32 after the condenser temperature Tc exceeds the second reference value Tr2 as described above.

However, the condenser temperature Tc may exceed the first reference value Tr1, if a thermal overload state such as an abnormally high temperature around the refrigerator continues to some extent. In this case, returning to FIG. 7, the process reaches step S32, when the condenser temperature Tc exceeds the first reference value Tr1 (that is, Yes at step S22). At step 32, the rotational speed of the compressor 32 is set to 0 rps, so that the compressor 32 is deactivated to protect the refrigeration unit 30. Further the protective duration accumulating timer TM1 is reset to start at step 32. The deactivation of the compressor 32 at step 32 corresponds to a protective operation of the present invention.

The rotational speed of the compressor 32 is actually controlled at step S33 based on the result of step S32. Thereafter the process returns to step S21.

Then the process likely proceeds to step S29 from step S21, because the protective duration accumulating timer TM1 is just started and therefore the value thereof should be less than 6 minutes (i.e., No at step S21). Thus the deactivation of the compressor 32 is continued for a predetermined time (e.g. 6 minutes in the present embodiment). When 6 minutes have elapsed after the compressor 32 is forcibly halted, the process proceeds from step 21 to step S22 if the inside temperature Tx is equal to or higher than the target temperature Tt (i.e., Yes at step S21). Thus the controlled refrigerating operation is automatically resumed, so that food, or the like, in the refrigerator is protected.

However, the refrigerant pressure should continue to increase in the event of a failure of the condenser fan 33A of the condenser 33, for example. In this case, the process reaches step S32 again, since the condenser temperature Tc still exceeds the first reference value Tr1 (that is, Yes at step S22). Then the compressor 32 is deactivated for 6 minutes again, so that the refrigeration unit 30 is protected.

The effects of the present embodiment are as follows. In the present embodiment, similar to the above first embodiment, the second reference value Tr2 is set to a value corresponding to a limit pressure, in response to which the protective operation has been conventionally performed. The first reference value Tr1 is set to a value corresponding to a higher pressure than the limit pressure. This is desirable because the refrigeration unit 30 can operate through a brief state of the limit pressure. Further, in the case of a pressure test on the compressor 32, a short-term pressure test can be relatively easily performed.

In most cases, halting of the compressor 32 due to pressure increase in the refrigerant can be prevented by gradually lowering the performance of the compressor 32 after the condenser temperature Tc exceeds the second reference value Tr2. Thus the refrigerating operation is continued when thermal load on the refrigeration unit 30 rapidly increases, so that the rise in the inside temperature Tx is suppressed.

However, the condenser temperature Tc may exceed the first reference value Tr1, if a thermal overload state such as an abnormally high temperature around the refrigerator continues to some extent. In this case, according to the present embodiment, the compressor 32 is deactivated for a predetermined time and thereby protecting the refrigeration unit 30.

Further, according to the present embodiment, the control portion 50 as a comparator compares the measured value of the refrigerant pressure (i.e., the condenser temperature Tc) with the third reference value lower than the second reference value. Then the control portion 50 (as a compressor controller) provides a function to limit raising of the compressor performance if the measured value of the refrigerant pressure is between the third reference value Tr3 and the second reference value Tr2. This limits the refrigerant pressure from easily increasing beyond the second reference value Tr2.

According to the present embodiment, the compressor 32 is automatically restored to operation when the situation allows, even if it is halted or deactivated for protecting the refrigeration unit 30. The reason that the measured value of the refrigerant pressure exceeds the first reference value Tr1 is not always a failure of the condenser fan 33A or the like, but may be a temporal overload or the like. Therefore the refrigeration unit 30 includes the protective duration accumulating timer TM1 for accumulating the time during the protective operation, and the control portion 50 as the compressor controller discontinues the protective operation, if the measured value of the refrigerant pressure decreases to the first reference value Tr1 when the protective duration accumulating timer TM1 reaches a predetermined time (e.g. 6 minutes).

Thus the compressor 32 may be automatically restored when the predetermined time elapsed after the protective operation is started, so that the original function (e.g., cold storage function for food or the like) of the refrigeration unit 30 is interrupted as little time as possible.

Third Embodiment

Figure 8:
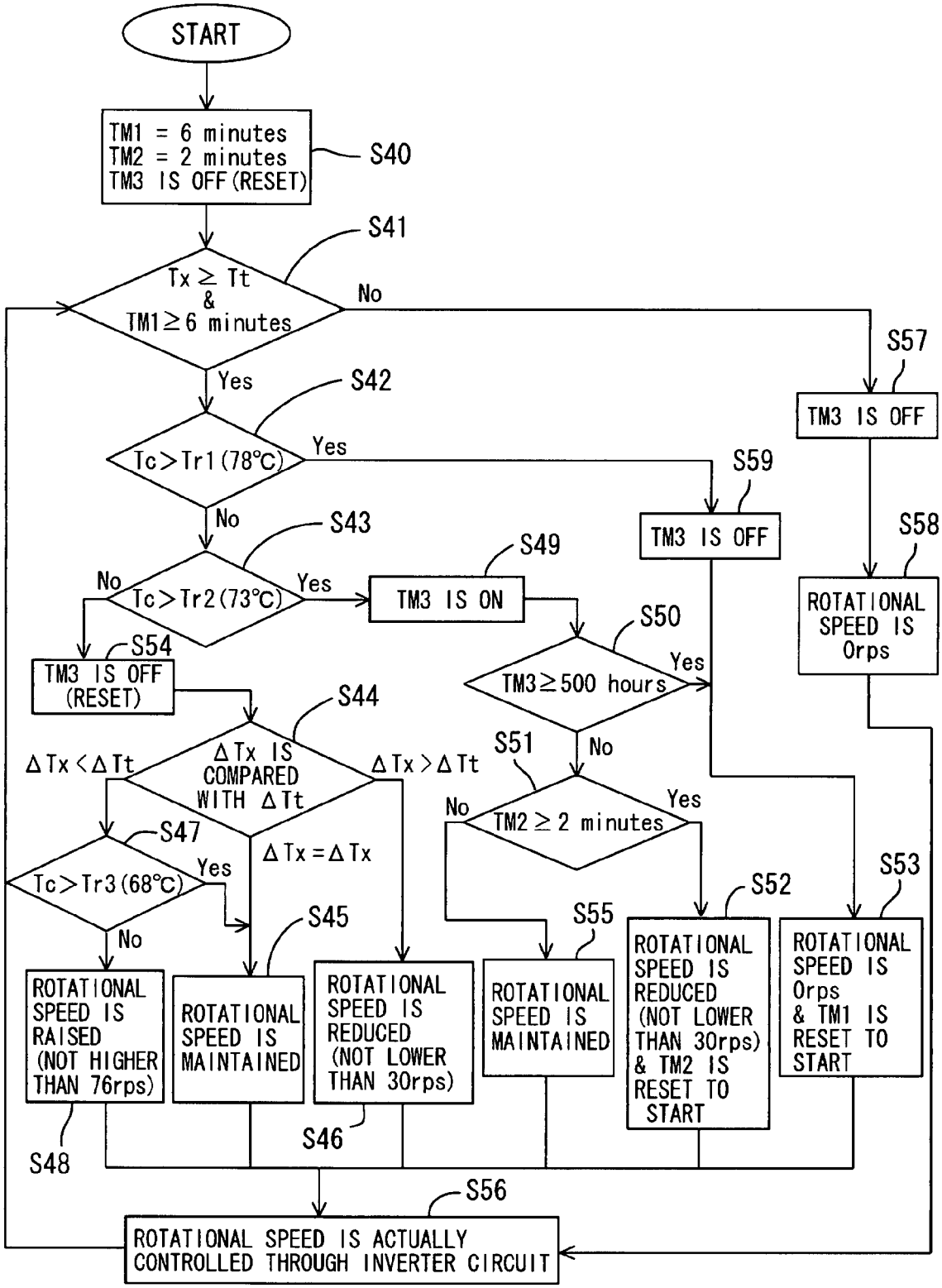
FIG. 8 is a flowchart of a controlled refrigerating operation according to a third embodiment.

FIG. 8 is a flowchart of a software-related part of a controlled refrigerating operation performed by a control portion of a refrigeration unit according to a third embodiment of the present invention. The present embodiment differs from the above second embodiment in that an accumulating timer TM3 is provided for accumulating the time during which the measured value of the condenser temperature Tc exceeds the second reference value Tr2. The accumulating timer TM3 of the present embodiment corresponds to an accumulating timer of the present invention.

The other constructions of the present embodiment are similar to the above second embodiment. Therefore, in the following explanation, the same or similar constructions are designated by the same symbols as the first embodiment, and redundant explanation is omitted.

Referring to FIG. 8, the accumulating timer TM3 is reset at the initialization step S40. However the timer TM3 is not started at this time, but stopped (i.e., turned off).

When it is determined at step 43 that the condenser temperature Tc exceeds the second reference value, the timer TM3 is started at step S49 to accumulate the time if the timer TM3 is off. If the timer TM3 is already accumulating the time, the accumulation is kept on. The operation is similar to the above second embodiment, unless the value of the timer TM3 exceeds a predetermined value (e.g., 500 hours in the present embodiment).

At step S50, it is determined whether the accumulated value of the timer TM3 is equal to or larger than 500 hours. The process proceeds from step S50 to step S53, when the timer TM3 reaches 500 hours (i.e., Yes at step S50). At step S53, the rotational speed of the compressor 32 is set to 0 rps, and thereby the compressor 32 is halted or deactivated. The deactivation of the compressor 32 at step S53 corresponds to a protective operation of the present invention. The predetermined value (e.g., 500 hours) of the present embodiment corresponds to a first predetermined time of the present invention.

The timer TM3 is stopped (i.e., turned off) at step S54, when it is determined that the condenser temperature Tc does not exceed the second reference value Tr2 (i.e., No at step S43). The timer TM3 is also stopped at step S57 or S59 before the compressor 32 is deactivated at step S58 or S53.

If the condenser temperature Tc continues to exceed the second reference value, which corresponds to the limit pressure of the refrigeration unit 30, for more than the predetermined time, a failure of the compressor 32 or the like is highly likely. Therefore, according to the present embodiment, the compressor 32 is deactivated if such a state continues for 500 hours, so that a fatal failure of the refrigeration unit 30 can be prevented.

Steps S41-S48 of the present embodiment correspond to steps S21-S28 of the second embodiment respectively, and are executed similarly. Steps S51, S52 and S55 of the present embodiment correspond to steps S30, S31 and S34 of the second embodiment respectively, and are executed similarly. Further steps S53, S58 and S56 of the present embodiment correspond to steps S32, S29 and S33 of the second embodiment respectively, and are executed similarly.

The effect of the present embodiment is as follows. It is actually undesirable for the refrigeration unit 30 when the refrigerant pressure is higher than the second reference value Tr2. This may cause a fatal failure of the refrigeration unit 30 as described above, particularly when the second reference value Tr2 is not appropriately determined.

Therefore the refrigeration unit 30 according to the present embodiment includes the accumulating timer TM3 for accumulating the time during which the measured value of the refrigerant pressure remains higher than the second reference value Tr2, and the control portion 50 (as a compressor controller) initiates a protective operation (i.e., halting of the compressor 32) if the accumulating timer TM3 reaches the predetermined time. Thus the protective operation is performed, when the time during which the refrigerant pressure exceeds the limit pressure reaches the predetermined time. Thereby a fatal failure can be prevented.

(Modifications)

The present invention is not limited to the embodiments explained in the above description with reference to the drawings. The following embodiments are also within the technical scope of the present invention, for example.

(1) In the above embodiments, the refrigeration unit 30 of the present invention is applied to an industrial refrigerator-freezer as an example. However, the present invention is not limited to this, but may be used for a vending machine, an ice maker, a water cooler or the like. The present invention is thus widely used as a refrigerant-compression-type refrigeration unit.

(2) In the above embodiments, the temperature of the center of the condenser 33 is detected as a physical amount corresponding to the refrigerant pressure on the high-pressure side of the refrigerant circuit 37. However the refrigerant pressure may be directly detected by a pressure sensor. That is, a physical amount corresponding to the refrigerant pressure on the high-pressure side of the refrigerant circuit 37 may be detected directly or indirectly.

The condenser temperature is proportional to the refrigerant pressure. That is, the condenser temperature increases, when the refrigerant pressure increases. The condenser temperature decreases, when the refrigerant pressure decreases.

However a physical amount inversely proportional to the refrigerant pressure may be detected instead of the condenser temperature.

(3) In the above embodiments, the compressor 32 is fully halted for protection of the refrigerant circuit 37. However, during the protective operation, the rotational speed of the compressor 32 may be first lowered to the minimum level and thereafter the compressor 32 may be halted. Alternatively the pressure of the refrigerant circuit 37 may be rapidly decreased by opening a valve connected to a refrigerant reservoir.

(4) In the above embodiments, the output frequency of the inverter circuit 51 is switched among the predetermined frequency levels, which are between 30 rps and 76 rps and of predetermined frequency intervals, during the normal refrigerating operation. However the intervals of the frequency levels are not required to be uniform. For example, the output frequency of the inverter circuit 51 may be varied more widely when the difference between the actual downslope ΔTx of the inside temperature Tx and the target slope ΔTx of the refrigerating temperature is larger.

(5) In the above embodiments, examples of reference values (i.e. Tr1, Tr2, and Tr3) are set forth, yet the present invention is not limited to these values. The present invention can be optimized and thus utilize various values without departing from the scope of the invention.

(6) In the above embodiments, examples of time measured by the protective duration accumulating timer TM1 are set forth, yet the present invention is not limited to these values. The present invention can be optimized and thus utilize various values without departing from the scope of the invention.

(7) In the above embodiments, examples of a rotation speed of the compressor are set forth, yet the present invention is not limited to these values. The present invention can be optimized and thus utilize various values without departing from the scope of the invention.

What is claimed is:

1. A refrigeration unit comprising:

a refrigerant circuit formed by sequentially connecting a variable performance compressor, a condenser, a throttle valve and an evaporator, wherein a refrigerant is compressed by said compressor, cooled through said condenser and vaporized through said evaporator for performing a cooling action, and wherein performance of said compressor is variable by changing a rotational speed of said compressor;

a sensor configured to measure a physical amount corresponding to a refrigerant pressure on a high-pressure side of said refrigerant circuit;

a comparator configured to compare a measured value of the physical amount with a first reference value corresponding to a first predetermined pressure of the refrigerant, to compare the measured value of the physical amount with a second reference value corresponding to a second predetermined pressure lower than the first predetermined pressure, and to compare the measured value of the physical amount with a third reference value corresponding to a third predetermined pressure lower than the second predetermined pressure; and a compressor controller configured to control said compressor in at least four control operations:

(i) a first control operation in which said compressor controller allows said compressor to maintain rotational speed and also prohibits said compressor from increasing rotational speed;

(ii) a second control operation in which said compressor controller lowers rotational speed of said compressor to gradually lower performance of said compressor;

(iii) a third control operation in which said compressor controller starts a protective operation of said refrigerant circuit; and (iv) a controlled refrigerating operation in which the rotational speed of said compressor can increase and decrease according to a desired performance of said refrigeration circuit;

wherein said compressor controller is configured to control said compressor under the controller refrigerating operation when the measured value of the physical amount is lower than the third predetermined value based on a comparison result from said comparator, and wherein said compressor controller is configured to control said compressor under the first control operation when the measured value of the physical amount is between the third predetermined value and the second predetermined value based on a comparison result from said comparator, to control said compressor under the second control operation when the measured value of the physical amount is between the second predetermined value and the first predetermined value based on a comparison result from said comparator, and to control said compressor under the third control operation when the measured value of the physical amount is higher than the first predetermined value based on a comparison result from said comparator.

2. The refrigeration unit of claim 1, wherein the refrigeration unit is arranged to control an inside temperature Tx, wherein a temperature sensor is provided for sensing the inside temperature Tx, and the compressor controller stores a set target temperature Tt, and wherein under the controlled refrigerating operation the compressor is started if $Tx \geqq Tt$ and the compressor is stopped if $Tx < Tt$.

3. The refrigeration unit of claim 2, wherein under the controller refrigerating operation the increase and decrease in rotational speed of the compressor is determined by comparing actual downslope ΔTx of the inside temperature with a target slope ΔTt.

4. The refrigeration unit of claim 1, wherein said compressor controller is configured to switch from said first control operation to said second control operation when the measured value of the physical amount increases beyond the second predetermined value during the first control operation.

5. The refrigeration unit of claim 1, wherein said compressor controller is configured to switch from said first control operation to said second control operation when the measured value of the physical amount increases beyond the second predetermined value during the first control operation, and to switch from said second control operation to said third control operation when the measured value of the physical amount increases beyond the first predetermined value during the second control operation.

6. The refrigeration unit of claim 1, wherein in the first control operation said compressor controller also allows said compressor to decrease rotational speed.

7. The refrigeration unit of claim 1, wherein in the first control operation said compressor controller allows said compressor to selectively maintain and decrease rotational speed according a desired performance of said refrigeration circuit.

8. The refrigeration unit of claim 1, wherein the protective operation of the third control operation is to halt operation of said compressor.

9. The refrigeration unit of claim 1, wherein compressor operation is not halted in the first control operation and is not halted in the second control operation.

10. The refrigeration unit of claim 1, wherein the third control operation is to halt operation of said compressor, and wherein compressor operation is not halted in the first control operation and is not halted the second control operation.

11. A refrigeration unit as in claim 1, wherein said sensor is a temperature sensor for measuring a temperature of said condenser as the physical amount corresponding to a refrigerant pressure on the high-pressure side of said refrigerant circuit.

12. A refrigeration unit as in claim 1, further comprising an accumulating timer configured to measure a time for a comparison result from said comparator indicating that the measured value of the physical amount is higher than the second predetermined value;

wherein said compressor controller causes the protective operation when the time measured by said accumulating timer reaches a first predetermined time.

13. A refrigerant unit as in claim 1, further comprising a protective duration accumulating timer configured to measure a time elapsed after the protective operation is started;

wherein said compressor controller discontinues the protective operation conditionally upon the protective duration accumulating timer reaching a second predetermined time.

14. A refrigerator storage cabinet comprising:

a heat insulating box including a storage room;

a refrigerant circuit for cooling said storage room, said refrigerant circuit being formed by sequentially connecting a variable performance compressor, a condenser, a throttle valve and an evaporator, wherein a refrigerant is compressed by said compressor, cooled through said condenser and vaporized through said evaporator for performing a cooling action, and wherein performance of said compressor is variable by changing a rotational speed of said compressor;

a sensor configured to measure a physical amount corresponding to a refrigerant pressure on a high-pressure side of said refrigerant circuit;

a comparator configured to compare a measured value of the physical amount with a first reference value corresponding to a first predetermined pressure of the refrigerant, to compare the measured value of the physical amount with a second reference value corresponding to a second predetermined pressure lower than the first predetermined pressure, and to compare the measured value of the physical amount with a third reference value corresponding to a third predetermined pressure lower than the second predetermined pressure; and a compressor controller configured to control said compressor in at least four control operations:

(i) a first control operation in which said compressor controller allows said compressor to maintain rotational speed and also prohibits said compressor from increasing rotational speed;

(ii) a second control operation in which said compressor controller lowers rotational speed of said compressor to gradually lower performance of said compressor;

(iii) a third control operation in which said compressor controller starts a protective operation of said refrigerant circuit; and (iv) a controlled refrigerating operation in which the rotational speed of said compressor can increase and decrease according to a desired performance of said refrigeration circuit;

wherein said compressor controller is configured to control said compressor under the controller refrigerating operation when the measured value of the physical amount is lower than the third predetermined value based on a comparison result from said comparator, and wherein said compressor controller is configured to control said compressor under the first control operation when the measured value of the physical amount is between the third predetermined value and the second predetermined value based on a comparison result from said comparator, to control said compressor under the second control operation when the measured value of the physical amount is between the second predetermined value and the first predetermined value based on a comparison result from said comparator, and to control said compressor under the third control operation when the measured value of the physical amount is higher than the first predetermined value based on a comparison result from said comparator.

15. The refrigerator storage cabinet of claim 14, wherein the refrigeration unit is arranged to control an inside temperature Tx of the storage room, wherein a temperature sensor is provided for sensing the inside temperature Tx, and the compressor controller stores a set target temperature Tt of the storage room, and wherein under the controlled refrigerating operation the compressor is started if $Tx \geqq Tt$ and the compressor is stopped if $Tx < Tt$.

16. The refrigerator storage cabinet of claim 15, wherein under the controller refrigerating operation the increase and decrease in rotational speed of the compressor is determined by comparing actual downslope $\Delta Tx$ of the inside temperature with a target slope $\Delta Tt$.

17. The refrigerator storage cabinet of claim 14, wherein said compressor controller is configured to switch from said first control operation to said second control operation when the measured value of the physical amount increases beyond the second predetermined value during the first control operation.

18. The refrigerator storage cabinet of claim 14, wherein said compressor controller is configured to switch from said first control operation to said second control operation when the measured value of the physical amount increases beyond the second predetermined value during the first control operation, and to switch from said second control operation to said third control operation when the measured value of the physical amount increases beyond the first predetermined value during the second control operation.

19. The refrigerator storage cabinet of claim 14, wherein in the first control operation said compressor controller also allows said compressor to decrease rotational speed.

20. The refrigerator storage cabinet of claim 14, wherein in the first control operation said compressor controller allows said compressor to selectively maintain and decrease rotational speed according a desired performance of said refrigeration circuit.

21. The refrigerator storage cabinet of claim 14, wherein the protective operation of the third control operation is to halt operation of said compressor.

22. The refrigerator storage cabinet of claim 14, wherein compressor operation is not halted in the first control operation and is not halted in the second control operation.

23. The refrigerator storage cabinet of claim 14, wherein the third control operation is to halt operation of said compressor, and wherein compressor operation is not halted in the first control operation and is not halted the second control operation.

24. A refrigerator storage cabinet as in claim 14, wherein said sensor is a temperature sensor for measuring a temperature of said condenser as the physical amount corresponding to a refrigerant pressure on the high-pressure side of said refrigerant circuit.

25. A refrigerator storage cabinet as in claim 14, further comprising an accumulating timer configured to measure a time for a comparison result from said comparator indicating that the measured value of the physical amount is higher than the second predetermined value;

wherein said compressor controller causes the protective operation when the time measured by said accumulating timer reaches a first predetermined time.

26. A refrigerator storage cabinet as in claim 14, further comprising a protective duration accumulating timer configured to measure a time elapsed after the protective operation is started;

wherein said compressor controller discontinues the protective operation conditionally upon the protective duration accumulating timer reaching a second predetermined time.

* * * * *